US005436527A

United States Patent [19]

Koenig et al.

[11] Patent Number: 5,436,527

[45] Date of Patent: Jul. 25, 1995

[54] CIRCUIT FOR OPERATING A FLUORESCENT LAMP

[75] Inventors: Winfried Koenig, Pfinztal-Berhausen; Florian Schwabe, Karlsruhe; Reinhold Fiess, Durbach; Peter Scharlach, Königsfeld, all of Germany

[73] Assignee: Robert Bosch GmbH, Stuttgart, Germany

[21] Appl. No.: 178,311

[22] PCT Filed: Jul. 9, 1992

[86] PCT No.: PCT/DE92/00566

§ 371 Date: Jan. 11, 1994

§ 102(e) Date: Mar. 10, 1994

[87] PCT Pub. No.: WO93/01694

PCT Pub. Date: Jan. 21, 1993

[30] Foreign Application Priority Data

Jul. 11, 1991 [DE] Germany ..... 41 22 957.6
Jun. 10, 1992 [DE] Germany ..... 42 18 959.4

[51] Int. Cl.[6] ..... H05B 37/00

[52] U.S. Cl. ..... 315/97; 315/94; 315/96; 315/98; 315/101

[58] Field of Search ..... 315/94, 97, 96, 98, 315/101, 105

[56] References Cited

U.S. PATENT DOCUMENTS 3,906,301 9/1975 Fisher ..... 315/97
4,358,683 11/1982 Seifert ..... 315/94
5,319,281 6/1994 Roth ..... 315/94

*Primary Examiner*—Robert J. Pascal
*Assistant Examiner*—Reginald A. Ratliff
*Attorney, Agent, or Firm*—Kenyon & Kenyon

[57] ABSTRACT

In a circuit for operating a fluorescent lamp with controllable luminance, with the fluorescent lamp comprising a discharge path and heater coils, the discharge path is connected through a transformer to a controllable alternating current source. The current through the heater coils is preferably controllable in such fashion that the sum of the current through the discharge path and through the heater coils remains essentially constant.

12 Claims, 3 Drawing Sheets

CIRCUIT FOR OPERATING A FLUORESCENT LAMP

FIELD OF THE INVENTION

The present invention relates to circuits for operating fluorescent lamps.

BACKGROUND OF THE INVENTION

Graphic display devices using liquid-crystal technology are being used increasingly to display information in motor vehicles. Because of the high optical demands, so-called "active displays" with internal color filters are used with transparent lighting. Powerful back-lighting sources with adjustable luminance are required for this purpose.

Various requirements are imposed on these light sources. In addition to uniform illumination and high electro-optical efficiency, low heat emission and low temperature dependence of the luminance are required. Because of the considerable changes that occur in the lighting conditions in a motor vehicle, a luminance which can be controlled over a wide range is required. The minimum luminance must be less than 100 cd/m$^2$ and the maximum luminance must be greater than 25,000 cd/m$^2$. Finally, white light must be radiated over the entire dimming range.

Because of their efficiency and associated low heat emission, as well as their flat design, fluorescent lamps, especially compact fluorescent lamps, are suitable for this purpose. However, there are difficulties relating to the broad dimming range and temperature independence.

The goal of the present invention is to provide a circuit for operating a fluorescent lamp which permits fulfillment of the above requirements.

SUMMARY OF THE INVENTION

The present invention is directed to a circuit for operating a fluorescent lamp with a controllable luminance, including a discharge path and a plurality of heater coils, wherein the discharge path is connected through a first transformer to a controllable source of alternating current and wherein the current through the heater coils is controllable so that the total of the current through the discharge path and the current through the heater coils remains essentially constant.

The circuit according to the present invention allows control of luminance in the stated range with low temperature dependence of the luminance, good efficiency, and low heat emission. Another advantage of the circuit according to the present invention consists in the fact that the lamp current is limited in the negative area of the U-I curve.

The circuit according to the present invention is especially advantageously suited for back-lighting sources of liquid-crystal displays. Other applications for which similar requirements apply are not ruled out, however.

DETAILED DESCRIPTION

Figure 1:
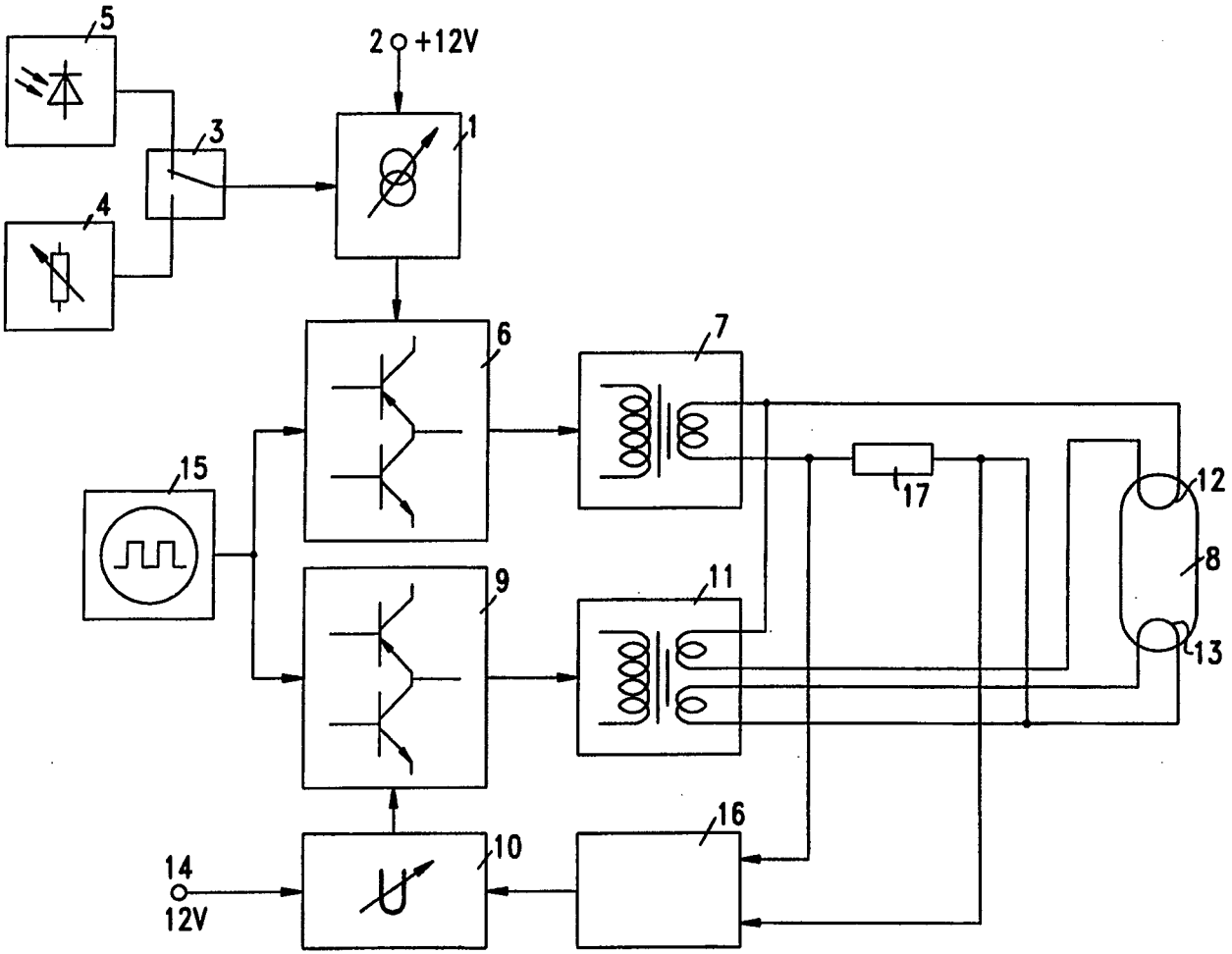
FIG. 1 is a block diagram of an embodiment of the present invention.

Equivalent parts have been given the same reference numerals in the figures.

In the embodiment shown in FIG. 1, a controllable DC power supply 1 is provided, connected at 2 to the vehicle electrical system of a motor vehicle. Controllable power supplies are known of themselves and are characterized by an at least dynamically large internal resistance, so that they deliver a current that is largely independent of the resistance of the connected load. A simple design for a controllable power supply consists of a transistor in an emitter-base circuit, in whose collector lead the load is connected and whose base is charged with a control voltage or control current.

Power supply 1 can be controlled by a selector switch 3 either through a manually adjustable voltage divider 4 or by a brightness meter 5, with automatic adjustment of the luminance to the ambient brightness. A first push-pull chopper 6 and a lamp transformer 7 produce a controllable alternating current whose amplitude is determined by the direct current supplied and which is fed to the discharge path of a fluorescent lamp 8.

Another chopper 9 likewise converts the output voltage from a power supply for heating coils 10 into an alternating voltage which is supplied through a heater transformer 11 to the heating coils 12, 13 of the fluorescent lamp 8.

The power supply 10 for the heater coils likewise receives, through an input 14, the voltage from the vehicle electrical system, 12 V for example.

Both push-pull choppers 6 and 9 are controlled by a push-pull generator 15. A frequency of approximately 60 kHz is advantageous for this purpose. The luminance then has a maximum, since renewed ignition at each halfwave is not necessary at such high frequencies. This reduces the lifetime upon dimming only insignificantly.

In the block diagram shown in FIG. 1, a circuit 16 is also provided for controlling the heating current, to which the magnitude of the current through the discharge path of a current measuring resistance 17 is supplied. Details of this control will be described in greater detail in conjunction with FIG. 2.

Figure 2A:
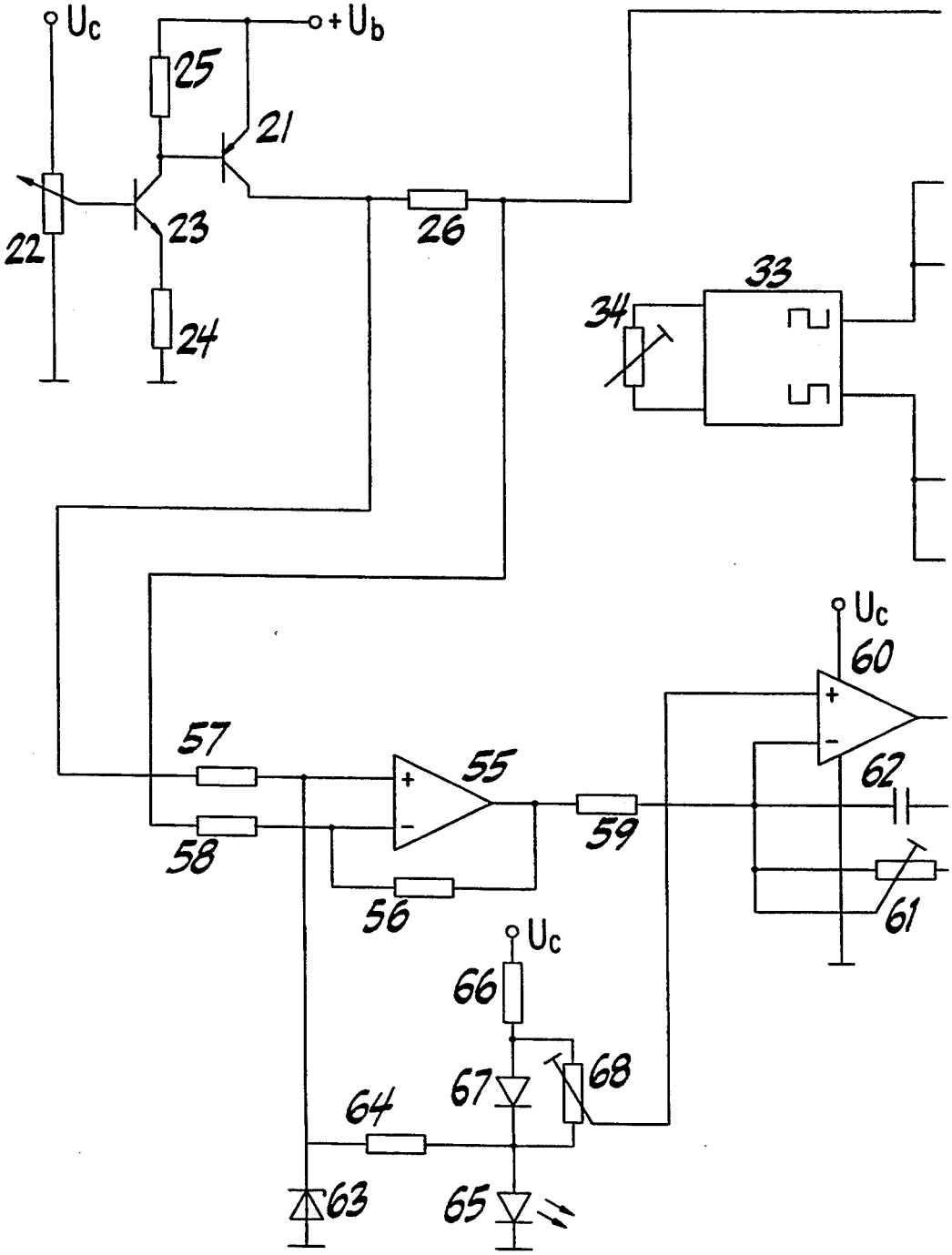
FIG. 2 is a detailed drawing of the essential features of another embodiment.
Figure 2B:
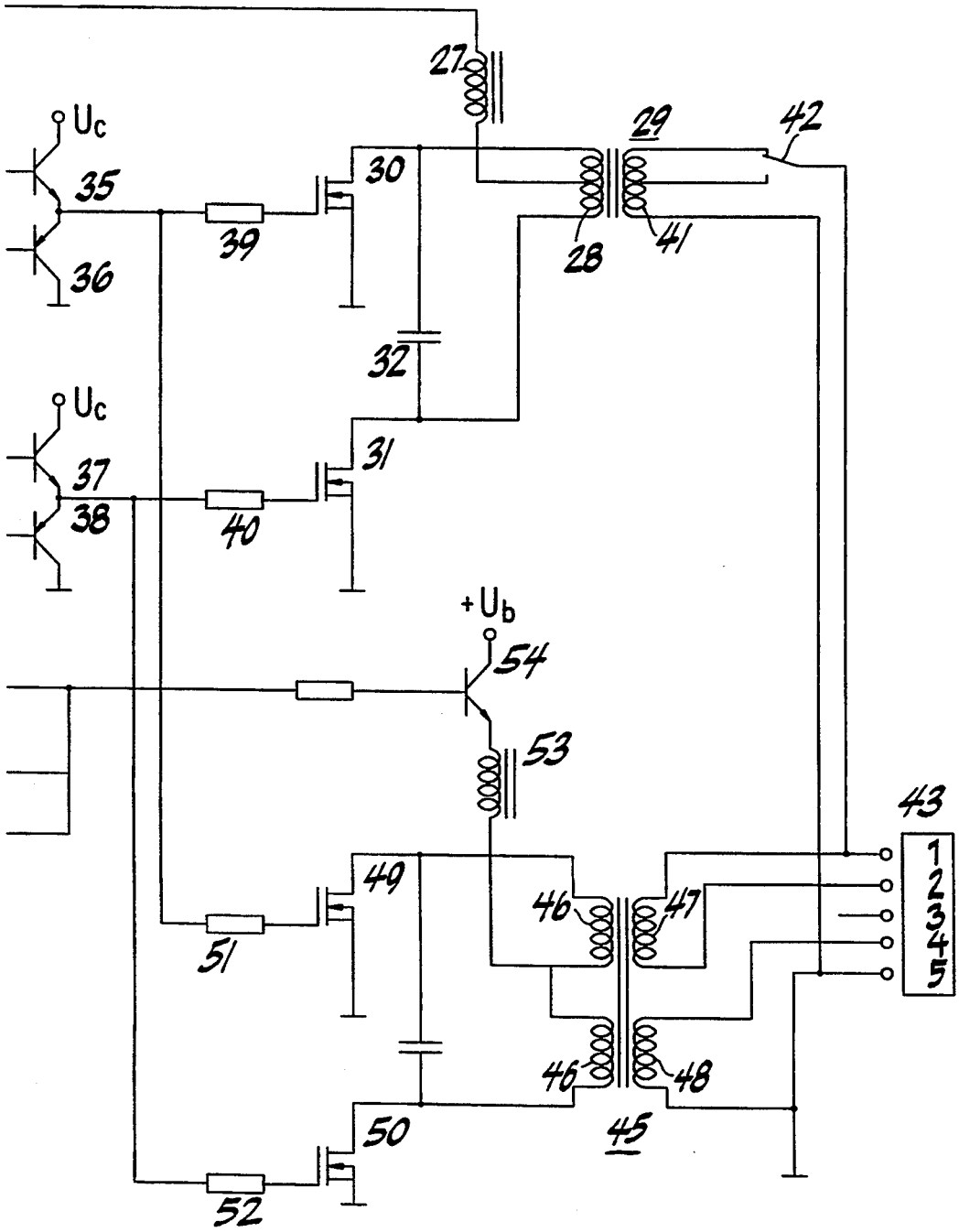

In the circuit shown in FIG. 2, the DC source is formed by a transistor 21 whose emitter is connected to the positive pole of the operating voltage source $+U_b$, for example a 12 V or 24 V vehicle battery. The negative pole of the operating voltage source, not shown, is connected to ground potential. The magnitude of the direct current can be adjusted by means of a potentiometer 22, connected to a stabilized DC voltage $U_c$. The wiper of potentiometer 22 is connected with the base of a transistor 23 which has an emitter resistor 24 and a collector resistor 25 and whose collector is connected to the base of transistor 21.

In the collector circuit of transistor 21, a current measuring resistor 26 is provided in which a voltage is dropped which is proportional to the lamp current. The direct current delivered by transistor 21 is supplied through a reactor 27 of the center tap of primary winding 28 of lamp transformer 29. The two ends of the symmetrically designed primary winding 28 are each connected to the drain electrode of a field effect transistor 30, 31 and are also connected together by a capacitor 32.

Field effect transistors 30, 31 form a push-pull output stage and are controlled for this purpose by squarewave voltages 180° out of phase. The control voltages are generated in an oscillator 33 whose frequency can be adjusted with the aid of a potentiometer 34 to the resonant frequency of the oscillator circuit formed by the primary winding 28 and the capacitor 32. This has the advantage that the resonant circuit formed by the primary winding 28 and the capacitor 32 does not have to be made adjustable since no exactly predetermined frequency is required to operate the fluorescent lamp.

With regard to function, it should be mentioned that dimming of the tubes involves a change in the amplitude of the high-frequency sinusoidal alternating current. The frequency is advantageously selected to be above 20 kHz because this produces a high dimming ratio of 400:1 and the lifetime of the lamp is advantageously not adversely affected by the dimming. According to FIG. 2, a chopped direct current is switched through the two FET switches 30, 31 in 20 to 100 kHz push-pull operation to the primary of transformer 29. The capacitor 32, together with the primary inductance of the transformer 29, the additional series inductance 27, and the lamp on the secondary side forms a resonant circuit. This resonant circuit permits conversion of the direct current into a nearly proportional higher-frequency sinusoidal alternating current, with which the brightness of the discharge lamp can be controlled. To generate the resonant frequency of the resonant circuit, for example 50 kHz, suitable dimensioning of the capacitor 32 and the lamp transformer 29 is required. In order to achieve the desired proportionality between the amplitude of the sinusoidal alternating current and the direct current supplied, the following dimensioning guidelines are therefore provided:

$$w^*L_t < R_l/\ddot{u}^2 \qquad a)$$

$W = 2^*\pi^*f$ f = resonant frequency of the parallel resonant circuit.

$L_t$ = primary inductance of transformer $R_l$ = ohmic equivalent resistance of lamp $\ddot{u}$ = transformation ratio of transformer $$L_s > 8^*L_t \qquad b)$$

$L_s$ = value of series inductance.

When these guidelines are observed, the primary inductance of the transformer together with the capacitance and the series inductance connected in parallel form a structure which can resonate. A portion of the energy is fed to the lamp as equivalent power.

If the dimensioning guidelines are not observed, and too much equivalent power is removed from the resonant circuit, oscillation cannot be maintained. The circuit then functions like a conventional push-pull chopper.

The push-pull outputs of the oscillator 33 are each connected by a push-pull driver 35, 36; 37, 38 and a protective resistor 39, 40 with the gate electrodes of field effect transistors 30, 31.

The secondary winding 41 of the lamp transformer 29 has a tap so that, with the aid of a selector switch 42, either half or all the number of turns can be connected with the terminals "1" and "5" of the lamp base 43 provided for the discharge path. At a battery voltage of $U_b$=12 V, the selector switch 42 is in the position shown. For operation on a 24 V battery, selector switch 42 is moved to the lower position so that the transformation ratio of lamp transformer 29 is adjusted for the higher operating voltage. By controlling the heating current, which will be described in more detail below, and by stabilizing the operating voltage $U_c$, no further measures to adjust to various operating voltages are required.

To generate the heating current, a heater transformer 45 with a push-pull primary winding 46 and two secondary windings 47, 48 is used. The latter are connected with terminals "1" and "2" as well as "4" and "5" of the lamp base 43. The primary winding 46 of the heater transformer 45 is connected to ground by two field effect transistors 49, 50 for push-pull operation. The field effect transistors 49, 50 are controlled through damping resistors 51, 52 by push-pull drivers 35, 36; 37, 38.

The center tap of primary winding 46 is connected through a heating coil 53 and the emitter-collector lead of the transistor 54 with the positive pole of the operating voltage $+U_b$. The heating voltage and hence the heating current can be controlled at the base of the transistor 54.

To control the heating current, the difference between the voltages at the end points of the current measuring resistor 26 is originally determined with the aid of an operational amplifier 55 and the corresponding resistances 56, 57, 58. A voltage value corresponding to this difference is supplied through a resistor 59 to the inverting input of another operational amplifier 60, whose amplification can be adjusted by a potentiometer 61. A capacitor 62 is connected in parallel with the potentiometer 61 to damp interference voltages.

A comparison voltage is supplied to the non-inverting input of the operational amplifier 60, said voltage being obtained from the voltage stabilized with the aid of a zener diode 63. For this purpose this voltage is fed through a series resistance 64 of a light-emitting diode 65 connected in the conducting direction. For comparison, an adjustable voltage is added to the resultant voltage of approximately 1.5 V. The adjustable voltage is obtained by means of a resistor 66 and a diode 67 wired in the conducting direction, with the total of the constant and adjustable voltages from the wiper of a potentiometer 68 being supplied to the non-inverting input of the differential amplifier 60.

As already stated in conjunction with FIG. 1, the heating current is controlled in such fashion that the total of the heating current and lamp current is constant, as may be shown by the following equation:

$$i_H = k_1 - k_2 \cdot i_L$$

The constant $k_1$ can be adjusted with potentiometer 68 and constant $k_2$ can be adjusted with potentiometer 61.

Additional embodiments of the circuit according to the present invention include a conducting film or a transparent heating film applied to the glass surface of the fluorescent lamp.

What is claimed is:

1. A circuit for operating a fluorescent lamp with a controllable luminance, wherein the fluorescent lamp includes a plurality of heater coils, the circuit comprising:

a first transformer;

a first controllable source of alternating current coupled to the first transformer, a discharge path being formed through the first transformer and the first controllable source; and a controllable heater circuit coupled to the plurality of heater coils, wherein a current through each of the plurality of heater coils, $i_H$, is controlled by the controllable heater circuit so that a sum of a current through the discharge path, $i_L$, and the current through each of the plurality of heater coils, $i_H$, remains essentially constant according to the formula $k_2 \cdot i_L + i_H = k_1$, wherein $k_1$ is a sum constant and $k_2$ is a weighting constant.

2. A circuit according to claim 1, wherein the first controllable source of alternating current includes a first controllable source of direct current, and wherein the first controllable source of direct current is coupled to a primary winding of the first transformer via first and second semiconductor switches, the first and second semiconductor switches being switchable in push-pull operation.

3. A circuit according to claim 1, wherein the controllable heater circuit includes a second transformer having a secondary winding connected to each of the plurality of heater coils and wherein a primary winding of the second transformer is connected to a second controllable source of direct current via third and fourth semiconductor switches, wherein the third and fourth semiconductor switches are switchable in push-pull operation.

4. A circuit according to claim 3, further comprising a current measuring resistance provided in the discharge path, and wherein one output of the current-measuring resistance is connected to a control-circuit of the controllable heater circuit which controls the second controllable source of direct current.

5. A circuit according to claim 1, wherein the alternating current from the first controllable source of alternating current has a frequency of approximately 60 Khz.

6. A circuit according to claim 1, wherein a conducting film is applied to a glass surface of the fluorescent lamp.

7. A circuit according to claim 6, wherein a surface of the fluorescent lamp is provided with a transparent heating film.

8. A circuit according to claim 1, wherein the circuit controls a liquid-crystal display device employed as a back lighting source in a motor vehicle.

9. A circuit according to claim 2, wherein the first controllable source of direct current includes a first operating voltage source having two poles, wherein the primary winding of the first transformer is provided with a center tap, the center tap being connected through a reactor to the first controllable source of direct current, and wherein each of the first and second semiconductor switches is connected between one end of the primary winding of the first transformer and one pole of the first operating voltage source, the first controllable source of direct current being connected to the other pole of the first operating voltage source.

10. A circuit according to claim 9, wherein the second controllable source of direct current includes a second operating voltage source having two poles, wherein the primary winding of the second transformer is provided with a center tap, the center tap being connected through a reactor to the second controllable source of direct current, and wherein each of the third and fourth semiconductor switches is connected between one end of the primary winding of the second transformer and one pole of the second operating voltage source, and wherein the second controllable source of direct current is connected to the other pole of the second operating voltage source.

11. A circuit according to claim 9, wherein each of the first and second semiconductor switches is disposed between one end of a winding of the first transformer and ground.

12. A circuit according to claim 9, wherein each of the third and fourth semiconductor switches is disposed between one end of a winding of the second transformer and ground.

* * * * *

UNITED STATES PATENT AND TRADEMARK OFFICE

CERTIFICATE OF CORRECTION

PATENT No. : 5,436,527

DATED : July 25, 1995

INVENTOR(S): W. Koenig

It is certified that error appears in the above-identified patent and that said Letters Patent is hereby corrected as shown below:

Column 1, line 68, after "embodiment" insert --of the present invention--.

Column 5, line 31, "control-circuit" should be --control circuit--.

Column 6, line 19, "claim 9" should be --claim 3--.

Column 6, line 36, "claim 9" should be --claim 10--.

Signed and Sealed this

Sixth Day of February, 1996

*Attest:*

Bruce Lehman

BRUCE LEHMAN

*Attesting Officer*

*Commissioner of Patents and Trademarks*